US008556745B2

(12) United States Patent
Currie

(10) Patent No.: US 8,556,745 B2
(45) Date of Patent: Oct. 15, 2013

(54) GOLF CLUB WITH AN INTERCHANGEABLE FACEPLATE

(76) Inventor: Marvin Kirk Currie, Spring, TX (US)

( * ) Notice: Subject to any disclaimer, the term of this patent is extended or adjusted under 35 U.S.C. 154(b) by 413 days.

(21) Appl. No.: 12/581,001

(22) Filed: Oct. 16, 2009

(65) Prior Publication Data

US 2010/0234121 A1 Sep. 16, 2010

Related U.S. Application Data

(63) Continuation-in-part of application No. 11/954,570, filed on Dec. 12, 2007, now Pat. No. 7,604,550.

(51) Int. Cl.
*A63B 53/00* (2006.01)

(52) U.S. Cl.
USPC ..... 473/342

(58) Field of Classification Search
USPC ..... 473/342
See application file for complete search history.

(56) References Cited

U.S. PATENT DOCUMENTS

| | | | | |
|---|---|---|---|---|
| 4,618,149 | A | 10/1986 | Maxel | |
| 4,884,808 | A | 12/1989 | Retzer | |
| 5,346,213 | A * | 9/1994 | Yamada | 473/329 |
| 5,437,447 | A * | 8/1995 | Rigutto | 473/251 |
| 5,509,660 | A * | 4/1996 | Elmer | 473/288 |
| D399,276 | S | 10/1998 | Hettinger et al. | |
| 6,227,986 | B1 * | 5/2001 | Fisher | 473/342 |
| 7,491,136 | B2 * | 2/2009 | Deng et al. | 473/349 |
| 8,033,931 | B2 * | 10/2011 | Wahl et al. | 473/342 |
| 2004/0009829 | A1 * | 1/2004 | Kapilow | 473/342 |
| 2004/0266548 | A1 * | 12/2004 | Cheng et al. | 473/342 |
| 2007/0021236 | A1 * | 1/2007 | Tucker et al. | 473/340 |

* cited by examiner

*Primary Examiner* — Stephen L. Blau
(74) *Attorney, Agent, or Firm* — Alan R. Thiele

(57) ABSTRACT

The present invention relates to a sand wedge type golf club, including an elongated shaft, a metal club head, a face plate, and an attachment mechanism. The club head has a wedge body and a hosel. The wedge body has a generally U-shaped frame with a planar front face and a back face. The generally U-shaped frame forms a cavity on the front face of the wedge body. The faceplate includes a ball contact surface and a mounting surface engaging the cavity and having internally threaded female connectors. The ball contact surface is co-planar with front face of the wedge body and has a plurality of grooves formed thereon. The attachment mechanism extends through the generally U-shaped frame to connect the internally threaded female connectors to the wedge body.

5 Claims, 5 Drawing Sheets

GOLF CLUB WITH AN INTERCHANGEABLE FACEPLATE

CROSS-REFERENCE TO RELATED APPLICATIONS

The present application claims continuation-in-part priority under 35 USC §120 from U.S. Ser. No. 11/954,570 filed Dec. 12, 2007, now U.S. Pat. No. 7,604,550B1, and entitled "SAND WEDGE WITH AN INTERCHANGEABLE FACEPLATE".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a golf club. More particularly, the present invention relates to a wedge golf club, which wedge golf club is used by golfers to strike a golf ball which has landed either in a sand trap or a bunker generally located in close proximity to a putting green or on the fairway between the tee and the putting green.

2. Description of Related Art Including Information Disclosed Under 37 CFR 1.97 and 37 CFR 1.98.

The present invention is used with a sand wedge. The sand wedge is a golf club used for a particular application in hitting golf shots characterized by its ability to give a golf ball a quick loft when the golf ball is hit and a high trajectory, along with a controlled spin imparted to the golf ball. The sand wedge is also commonly used by golfers to chop a golf ball out of tall grass or rough, in addition to hitting a golf ball from a sand-filled bunker.

The club head of the sand wedge has a particularly pitched ball contact surface and uneven shape to achieve the desired pattern of golf ball flight and golf ball rotation after contact with the pitched ball contact surface. The club head of a sand wedge also has a rounded bottom which contacts the sand in a bunker.

The distribution of weight and the shape of the club head provides more bounce for the golf club head of a sand wedge when hitting a golf ball. The golf club head of a sand wedge bounces off sand or the ground rather than digging into sand or the ground. These considerations make the sand wedge ideal for hitting a golf ball from the unstable sand surface found in a sand trap to provide more control and accuracy regarding the flight and direction imparted by the golfer on the golf ball when hitting the golf ball out of a sand trap.

Because of the frequency of use of the sand wedge in physical and environmental conditions, unlike the other grassy parts of a golf course, the sand wedge is especially vulnerable to physical degradation of the club head. Regular golf clubs, such as drivers, wedges and putters, do not impart the loft, the trajectory and the spin on the golf ball imparted by the sand wedge, thus they are not subject to the shortened life span and the wear and tear experienced by those golf clubs used in sandy conditions.

All golf clubs have a ball contact surface on the club head which contacts the surface of the golf ball. This ball contact surface typically has a plurality of grooves. The grooves are important because it is the grooves on the ball contact surface which enable the golfer to control the flight of the golf ball through the air. The grooves on the ball contact surface dig into the surface of the golf ball thus causing the golf ball to spin. The spinning motion imparted to the golf ball by the grooves on the ball contact surface allows the golfer to control the flight path of the golf ball and the rolling action of the golf ball after landing back on the ground. For example, backspin can be used on the golf ball to contact the surface of the green and effectively stick the golf ball in the place where the golf ball strikes the ground. As the edges of the grooves on the ball contact surface become smoother, the golf ball will not rotate as fast after being struck by the ball contact surface. As the edges of the grooves are worn, the golfer's ability to control the spin of the golf ball is diminished. When this happens, typically a golfer will have to replace the entire golf club when the edges of the grooves on the ball contact surface are no longer effective or are no longer predictable regarding the spin imparted on the golf ball.

The issue of the replacement of the replacement of the grooves on the ball contact surface of a club head is especially important for a sand wedge. The sand wedge is primarily used in a sandy environment. The sandy environment intensifies the erosion of the edges of the grooves in the ball contact surface. Repeated use of a sand wedge in a sandy environment decreases the life span of a sand wedge more quickly than the normal wear and tear on regular golf clubs. Furthermore, the material composition of the material from which the grooves in the ball contact surface are formed is important.

The ball contact surface for the golf ball can be made of harder or softer metals. Because of the physical properties of the metal selected, softer materials create a better feel for the golfer when striking the golf ball; however, the softer materials also degrade faster. Replacement of the grooves on the ball contact surface of the club head is an important consideration for maintaining the consistency the flight path and the spin of the golf ball as well as the feel of the golf club by the golfer as the club head makes contact with the surface of the golf ball.

In the past, inventors have addressed the problem of replacing the grooves on the ball contact surface of a golf club head without having to replace the entire golf club. Typically, some prior art golf club heads have a removable and replaceable plate. This removable and replaceable plate has a plurality of grooves. As the grooves in the removable and replaceable plate become worn, the removable and replaceable plate can be replaced with a new plate with new grooves. Several patents have issued to address the problem of replacing plates with grooves formed therein on golf club heads.

U.S. Pat. No. 5,437,47, issued on Aug. 1, 1995, to Rigutto, discloses a golf club putter. A face piece is attached to a front portion of the body of the golf club putter. Each face piece is removably attached to the golf club putter body. Each face piece can be different. Each face piece can have a different pitch to cause a differ angle of contact with the surface of the golf ball.

U.S. Pat. No. 5,509,660, issued Apr. 23, 1996, to Elmer, teaches another golf club head. There are two body parts to this golf club head. The first body part is a flat plate which is used to contact the surface of the golf ball. The second body part is a weighted frame that forms the rear side of the golf club head. The two body parts are connected together by screws to form a golf club head with an interchangeable face. The screws or rivets pass through a front surface of the first body part and connect to the second body part.

U.S. Pat. No. 4,618,149, issued on Oct. 21, 1986, to R. Maxel, teaches another golf club having interchangeable face plates. Each face plate has a planar back surface for attachment to the golf club head body. The front face of each face plate contains a surface for contacting the surface of the golf ball. This front face can have different characteristics such as curvature and grooves, to affect the flight of the golf ball after contact with the golf club head. Screws are attached through the front face of each face plate to the golf club head body. This invention is directed toward a particular type of golf club, specifically a fairway wood.

U.S. Pat. No. 4,884,808, issued on Dec. 5, 1989, to Retzer, teaches another golf club having exchangeable face plates. The club head of this invention has a face portion, a toe portion, and a heel portion. The face plate has a plurality of shafts extending from a back surface thereof. The shafts of the face plate fit into a series of holes on the face portion of the golf club head. Once the face plate is inserted into the series of holes, a screw is inserted through the bottom of the club head. The screw engages the shaft of the face plate in a transverse manner in order to secure the face plate to the club head body.

U.S. Design Pat. No. D399,276, issued on Oct. 6, 1998, to Hettinger et al., illustrates a golf club head having a face insert. This design discloses a golf club head with a planar front face and a curved back surface. The description of the design includes a reference to a removable face plate. However, the design drawing figures do not illustrate how the face plate is attached to the golf club head.

It is an object of the present invention to provide a sand wedge type golf club with an interchangeable face plate.

It is another object of the present invention to provide a sand wedge type golf club with easily removable and replaceable grooves on a faceplate.

It is an object of the present invention to provide a face plate for a golf club formed of a first material composition and a club head with a second composition, wherein the first composition and the second composition are different.

It is an object of the present invention to provide a face plate for a golf club with a unitary and planar front face.

It is still another object of the present invention to provide an attachment means for a golf club enabling secure attachment of the face plate to the golf club head without affecting the position of the ball contact surface of the faceplate with respect to the club head.

It is a further object of the present invention to reduce manufacturing costs and time to make a clubhead and faceplate assembly without affecting the quality of the golf club.

These and other object and advantages of the present invention will become apparent from a reading of the attached specification and the appended claims.

BRIEF SUMMARY OF THE INVENTION

The present invention relates to a golf club head and faceplate assembly. There is a metal golf club head including a wedge head body and a hosel. The hosel is secured to an elongated shaft. Affixed to the metal golf club head is the faceplate.

In one embodiment described in my U.S. Pat. No. 7,604,550 B1 the wedge type golf club head body has a generally open U-shaped frame portion, when the generally open U-shaped frame portion is viewed from the front face, and a back face between the toe and the heel portion of the golf club head.

In another embodiment described in my U.S. Pat. No. 7,605,550B1, the wedge type golf club head body has a generally U-shaped frame portion which generally U-shaped frame is partially closed by a separate blocking bar when viewed from the front face, and a back face between a toe and a heel portion of the golf club head.

In the following disclosure, the wedge type golf club head body has a covered generally U-shaped frame portion with a cross-bar section spanning the generally U-shaped frame portion and co-planar with a stop ledge along with a front face and back face between the toe and the heel portion of the golf club head.

In yet another embodiment, the wedge type golf club head body has a completely closed generally U-shaped frame portion with an extended length stop ledge which forms an integral backing plate, a front face, and a back face between the toe and the heel portion of the golf club head. The front face is planar at the toe portion. The generally U-shaped frame portion forms a cavity in the front face of the wedge type golf club head body.

The present invention also includes a faceplate having a ball contact surface and a mounting surface. The mounting surface on the back side of the faceplate engages the cavity in the front face of the golf club head body and has female connecting means or female connectors on a periphery. The female connectors are raised cylinders on the mounting surface of the faceplate to the wedge body with internal threads extending through the raised cylinders and into, but not through, the body of the faceplate. The grooved ball contact surface on the front of the faceplate is made to be co-planar with the front face of the wedge body.

An attachment means removably attaches to the female connection means on the mounting surface, on the back of the face plate, to the wedge body and is preferably removable headed screws. The attachment means extends through the generally U-shaped frame portion. In one embodiment the attachment means may also include the cross bar section across the back face of the wedge body. In the other embodiment the attachment means may also include the integral backing plate behind the generally U-shaped frame portion of the wedge body.

The cavity in the front face of the wedge body includes an indentation with a plurality of tiers therein, forming a proximal shoulder ledge and a distal stop ledge. The distal stop ledge has a plurality of holes aligned with the female connecting means on the mounting surface. The front face of the proximal shoulder ledge is in contact with the rim or periphery of the mounting surface of the interchangeable faceplate. The holes in the distal stop ledge engage respective raised cylinders of the female connecting means, and the screws lock the wedge body to the faceplate with the wedge body sandwiched between the cross bar section or the integral backing plate and the faceplate.

DETAILED DESCRIPTION OF THE EMBODIMENTS

Figure 1:
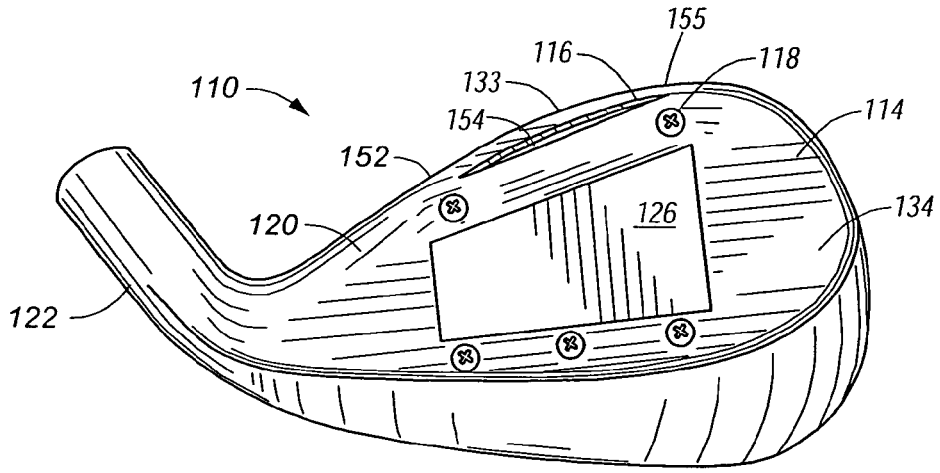
FIG. 1 is a back side elevational view of a first embodiment of the sand wedge type golf club of the present invention including a covered generally U-shaped frame portion.

A better understanding the two embodiments shown in the drawing figures and described below may be had by an understanding of the reference numbers used to describe the common elements which are listed below. In the first embodiment the reference numbers are preceded by the numeral 1 in the hundreds places and in the second embodiment the reference numbers are preceded by a 2 in the hundreds place.

12 elongated shaft
14 metal club head
16 face plate
18 attachment means
20 wedge body portion of metal club head (14)
22 hosel portion of metal club head (14)
24 ball contact surface of faceplate (16)
25 body portion of faceplace (16)
26 mounting surface of faceplate (16)
28 grooves in ball contact surface (24)
30 generally U-shaped frame portion of wedge body (20)
32 front face of metal club head (14)
34 back face of metal club head (14)
36 cavity within generally U-shaped frame portion (30)
38 plurality of tiers within cavity (36)
40 proximal shoulder ledge within cavity (36)
42 distal stop ledge within cavity (36)
44 holes in stop ledge (42) portion of wedge body (20)
46 front face of shoulder ledge (40)
50 female connecting means portion of attachment means (18)
52 screws portion of attachment means (18)

Figure 2:
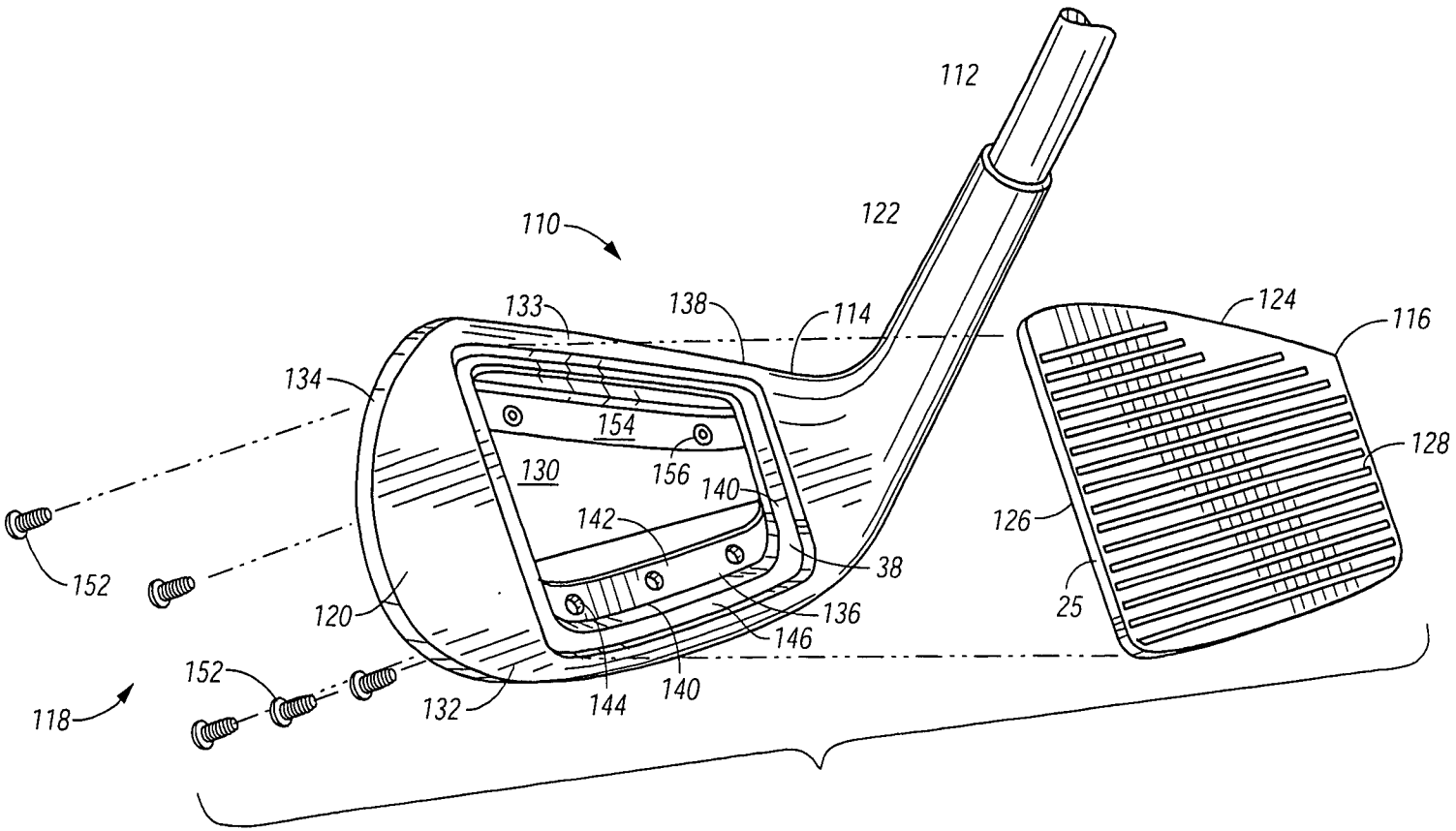
FIG. 2 is an exploded front side perspective view of the sand wedge type golf club shown in FIG. 1.
Figure 3:
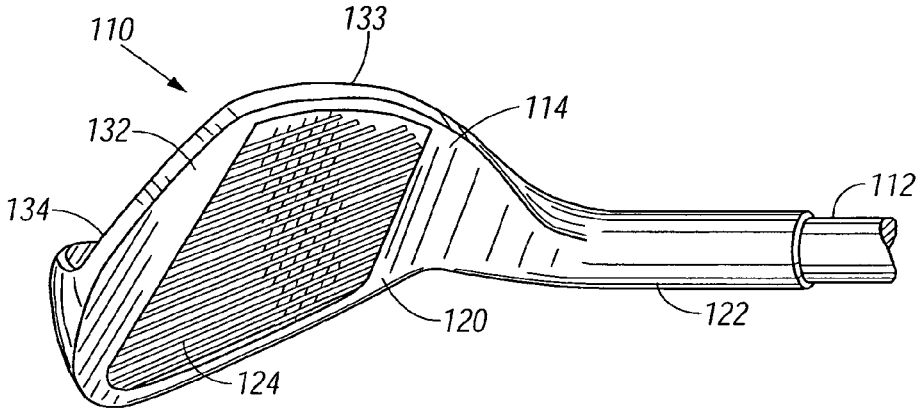
FIG. 3 is a front side perspective view of the sand wedge golf club as shown in FIG. 1 and in FIG. 2.

Referring to FIGS. 1-3, the first embodiment of the present invention is shown as a sand wedge type golf club 110 comprising an elongated shaft 112, a metal club head 114, a faceplate 116, and attachment means 118. The elongated shaft 112 has one end for connection to the metal club head 114 and another end (not shown) for a grip for use by the golfer. The metal club head 114 includes a wedge body portion 120 and a hosel portion 122. The hosel portion 122 is secured to the elongated shaft 112 at the one end of the shaft 112. The faceplate 116 has a ball contact surface 124 on its front side and a mounting surface 126 on its back side and a body portion therebetween.

The ball contact surface 124 is made to be co-planar with the front face 132 of the metal club head 114 when mounted therein.

The ball contact surface 124 has a plurality of grooves 128. These grooves 128 contact the surface of the golf ball during that portion the golf swing when the ball contact surface 124 strikes the golf ball. The attachment means 118 for the faceplate 116 to the wedge body 120 extends through the metal club head 114 and into the mounting surface 126 on the back of the face plate 116.

Figure 6:
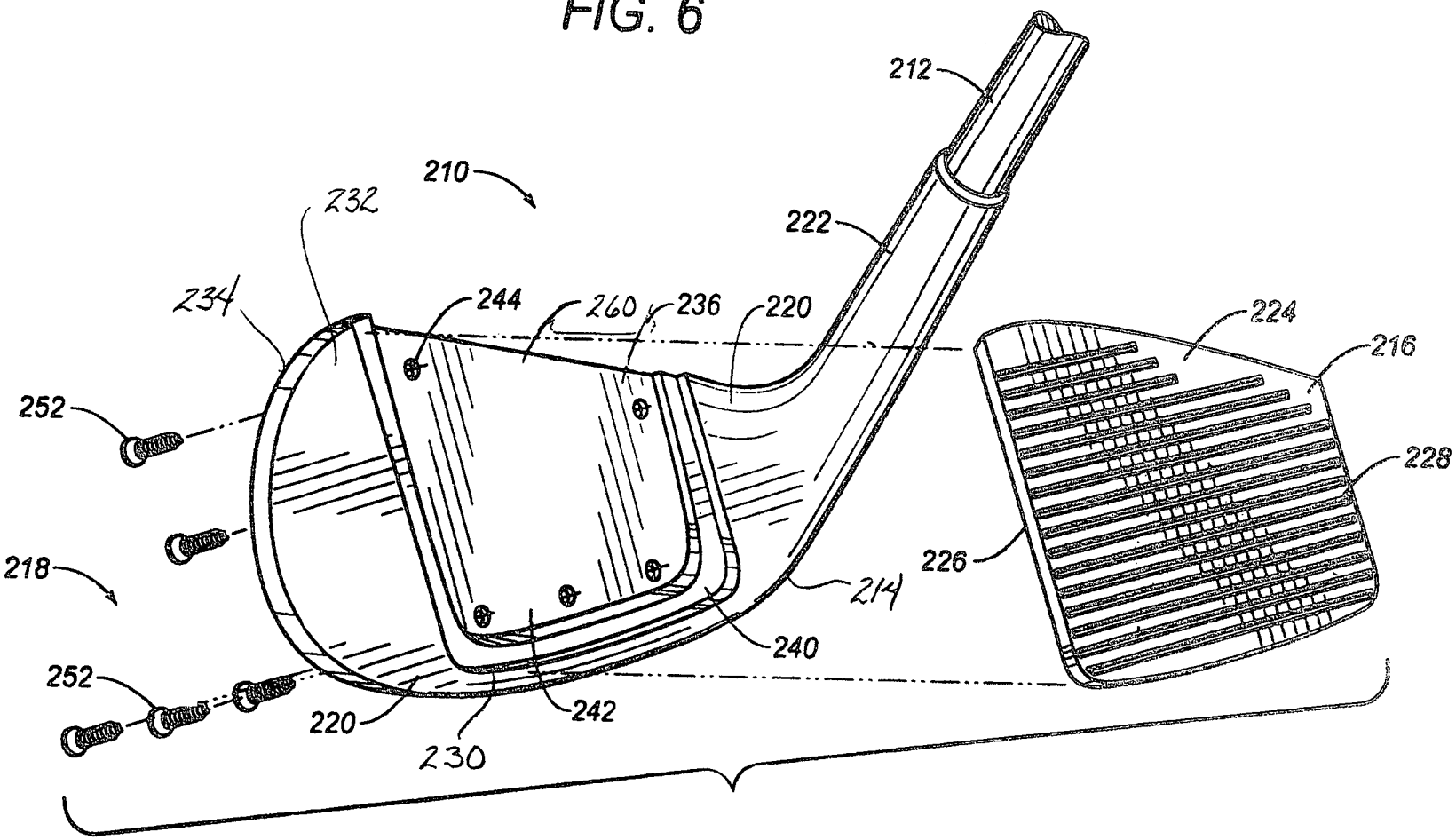
FIG. 6 is an exploded perspective view of a second embodiment of the sand wedge golf club of the present invention including a closed generally U-shaped frame portion.

FIG. 6 shows another embodiment of the sand wedge type golf club 210 of the present invention. This embodiment similarly includes an elongated shaft 212, a metal club head 214, a faceplate 216, and an attachment means 218. Importantly, the attachment means 218 are screws 252 engaging the female connecting means 250 on the back of the faceplate 216 through the backing 260 which serves as the distal stop ledge 242. The generally U-shaped frame 230 within the wedge body 220 is closed because a full backing 260 located at the same depth of the distal stop ledge 242 from the front face 232 of the metal club head 214 within the cavity 236 is formed across the entire wedge body 220. The screws 252 lock the faceplate 216 through the female connecting means 250 directly through the holes 244 without any exposure of the mounting surface 262 to the back face 234 of the metal club head portion 214 of the wedge body 220. The backing 260 and the mounting surface 226 sandwich the proximal shoulder ledge 240 of the wedge body 220 for secure fastening of the faceplate 216 to the metal club head 214 so that the ball contact surface 224 is positioned to be co-planar with the front face 232 of the metal club head 214.

The attachment means 118 shown in FIGS. 1-5 includes headed screws 152 and a cross bar section 154 on the back face 134 and forming a cover 155 across the top of the generally U-shaped frame portion 130 of the wedge body 120 portion of the metal club head. The bottom portion 153 of the cross bar section 154 extends across opposite ends of the generally U-shaped frame portion 130 and has holes 156 formed in the bottom portion 153 of the cross bar section 154. The cover portion 155 of the cross bar section 154 is positioned over the bottom portion 153 of the cross bar section 154. The headed screws 152 extend through the holes 156 and 144 to engage the female connecting means 150 on the mounting surface 126 on the back of the face plate 116. The cross bar section 154 prevents displacement of the faceplate 116 from the wedge body 120.

The holes 144 in the distal stop ledge provide an opening for the headed screws 152 which engage the internal threads within the female connecting means 150 on the back of the faceplate 116 to sandwich the wedge body 120 between the faceplate 116 and the cross bar section 154. The headed screws 152 engage the faceplate 116 to fixedly secure the mounting surface 126 around the rim on the back of the faceplate 116 against the front face 146 of the proximal shoulder ledge 140, while passing through the back face 134 of the wedge body. The cross bar section 154 and the mounting surface 126 sandwich the wedge body 120 for the locked position of the faceplate 116 against the wedge body 120.

The wedge body 120 of the first embodiment 110 has a covered U-shaped frame 130 and a crossbar section 154, a front face 132 and a back face 134 between the toe and the heel portions of the golf club head 114.

As indicated above in both embodiments, the front face 132, 232 of the metal club head 114, 214 is planar with the ball contact surface 124, 224 of the faceplate 116, 216 at the toe portion in both embodiments 110, 210. The back face 134, 234 of the metal club head 114, 214 has a shape with a bulged lower end, forming a distinctive sand wedge bottom and weight distribution. The rounded and heavier bottom end provides the desired bounce effect of the sand wedge 110, 210 during contact of the bottom of the metal club head 114, 214 against sand or dirt.

As shown in FIG. 2 and in FIG. 6 the generally U-shaped frame portion 130, 230 forms a cavity 136, 236 in the front face 132, 232. The cavity 136, 236 houses the faceplate 116, 216 such that the entire volume of the faceplate 116, 216 fits within the cavity 136, 236. The mounting surface 126, 226 enters into the cavity 136, 236 a sufficient distance so that the contact surface 124, 224 of the faceplate 116, 216 becomes flush with the front face 132, 232 of the metal club head 114, 214 along the generally U-shaped frame 130, 230.

The cavity 136, 236 is an indentation in the front face 132, 232, of the club head 114, 214 with a plurality of tiers 138, 238. The plurality of tiers 138, 238 form a proximal shoulder ledge 140, 240 and a distal stop ledge 142, 242 to prevent the faceplate 116, 216 from falling through the cavity 136, 236 in the generally U-shaped frame 130, 230. The proximal shoulder ledge 140, 240 and the distal stop ledge 142, 242 support the faceplate 116, 246 against contact with the surface of the golf ball during the golf swing. The proximal shoulder ledge 140, 240 is flush against the rim around mounting surface 126, 226. This flush metal-to-metal mounting of the rim of the mounting surface 126, 226 against the shoulder ledge 140, 240 assures that the ball contact surface 124, 224 of the faceplate 116, 216 is co-planar with the front face 132, 232 of the club head 114, 214. The distal stop ledge 142, 242 has a plurality of holes 144, 244 formed therein. Screws 152, 252 pass through holes 144, 244 to engage the female connecting means 150, 250 on the mounting surface 126, 226 on the back of the faceplate 116, 216.

Figure 4A:
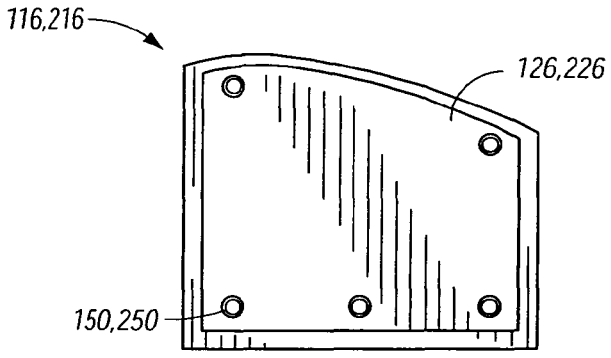
FIG. 4A is a rear elevational view of the faceplate of the present invention.
Figure 4B:
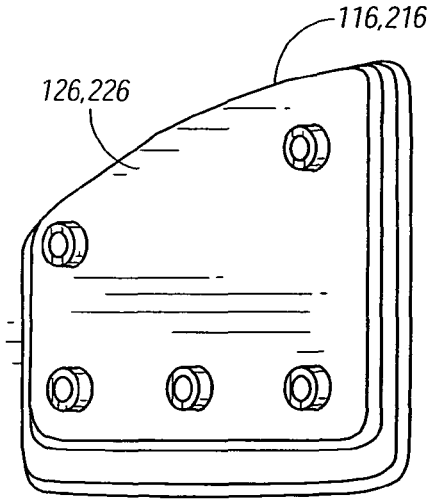
FIG. 4B is a rear perspective view of the faceplate shown in FIG. 4A.

FIG. 4 and FIG. 4B show a back view of the faceplate 116, 216 of the present invention, showing the mounting surface 126, 226. There are female connecting means 150, 250 on the mounting surface 126, 226 of the faceplate 116, 226. The holes 144, 244 of the wedge body 120, 220 are aligned with the female connecting means 150, 250. For example, FIG. 2 shows the placement of three holes 144 and the two holes 156 in the cross bar section 154 for the five female connecting means 150, 250 of the faceplate 116, 216.

FIG. 6 shows the placement of three holes 244 and the backing 260 for the five female connecting means 250 of the face plate 216. The female connecting means 150, 250 are arranged along a periphery of the faceplate 116, 216 to match the generally U-shaped frame portion 130, 230 of the wedge body 120, 220. The number of holes and connecting means is variable.

FIG. 4B shows the raised cylinders of the female connecting means 150, 250.

The female connecting means 150, 250 are internally threaded cylinders extending outwardly from the mounting surface 126, 226. The internal threads of the of the female connecting means 150, 250 extend through the cylinder and into the body 125, 225 of the faceplate 116, 216. Each hole 144, 244 of the distal stop ledge 142, 242 engages a corresponding threaded cylinder such that the faceplate 116, 216 is actually aligned and positioned before any screws 152, 252 are threaded into the female connecting means 150, 250. This alignment of the female connecting means 150, 250 with the corresponding holes prevents misalignment of the face plate 116, 216 and crooked application of the screws 152, 252 as well as assuring that the ball contact surface 124, 224 of the faceplate 116, 216 is co-planar with the front face 132, 232 of the club head 114, 214.

Figure 5:
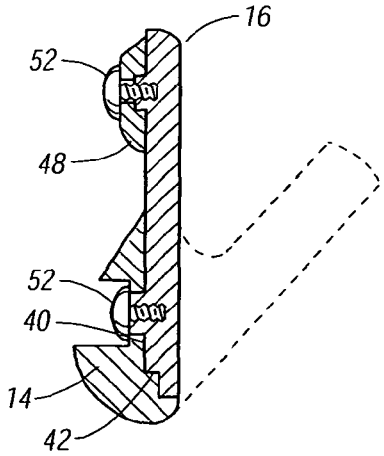
FIG. 5 is a side elevational view, in partial section, of the sand wedge golf club at line 5-5 in FIG. 1.

FIG. 5 shows a cross-sectional view of the embodiment shown in FIG. 1, illustrating the alignment of the distal stop ledge 142 with the integral cross bar 154 against the mounting surface 126. The bottom portion 153 of the cross bar section 154 is made integral with the wedge body 120. Additionally, the internally threaded female connecting means 150 are placed away from the intended contact with the golf ball during the golf swing. The screws 152 engage the holes 144 on the distal stop ledge 142 and the holes on the bottom portion 153 of the cross bar section 154, blocking the cross bar section 154 and faceplate 116 together on opposite sides of the wedge body 120 without direct contact to the wedge body 120. In this manner, the wedge body 120 is protected from excessive wear on the screw threads and from the deformations caused by screws.

FIG. 6 illustrates the alignment of the distal stop ledge 242 with the integral backing 260 against the mounting surface 226. The backing 260 is made integral with the wedge body 220. Additionally, the female connecting means 250 are placed away from the intended contact with the golf ball during the golf swing. The screws 252 engage the holes 244 on the distal stop ledge 242 and the holes 244 in the backing 260, locking the backing 260 and the faceplate 216 together on opposite sides of the wedge body 220 without direct contact to the wedge body 220. In this manner, the wedge body 220 is protected from excessive wear on the screw threads and from deformations caused by the screws.

The faceplate 116, 216 is comprised of a first material composition, including a metal, such as copper, brass, or stainless steel. The metal club head 114, 214 is comprised of a second material composition, including a different metal than the faceplate 116, 216. The different metal composition of the faceplate 116, 216 and metal club head 114, 214 allows the golfer to customize a particular weight and feel without purchasing an entirely new sand wedge. The first material composition of the faceplate 116, 216 is particularly important to be interchangeable. Softer metals for the ball contact surface 124, 224 provide a better feel for the golfer. However, the softer materials degrade faster. The present invention allows the golfer to chose and maintain the softer materials to provide a better feel of the golf club when it strikes the golf ball.

The attachment means 118, 218 removably attach the internally threaded female connecting means 150, 250 on the mounting surface 126, 226 of the faceplate 116, 226 to the wedge body 120, 220. The attachment means 118, 218 are screws 152, 252 extending through the generally U-shaped frame portion 130, 230. The screws 152, 252 pass through the holes 144, 244, such that the holes 144, 244 of the wedge body 120, 220 are not required to be threaded. The female connecting means 150, 250 can be internally threaded to provide the secure locking of the faceplate 116, 216 to the wedge body 120, 220. In this manner, the faceplate 116, 216 is removably attached to the wedge body 120, 220. A new or different faceplate 116, 216 can be attached to the sand wedge 110, 210 in order to replace the grooves 128, 228.

The sand wedge type golf club of the present invention provides an innovative sand wedge type golf club with an interchangeable face plate.

The attachment means with the cross bar section 154 or the backing 260 allows the faceplate 116, 216 to be attached without affecting the wedge body itself. The screws lock through the wedge body to mounting surface of the faceplate, such that the wedge body is sandwiched between the cross bar section or the backing and the faceplate. The wedge body is more resistant to wear. Also, the screw threads are not placed on the wedge body, so repeated use will not require replacement of the golf club.

The female connecting means provide additional support for locking the faceplate into the cavity in the front face of the club head. The raised cylinders engage holes on the stop ledge, such that the faceplate is kept in place during the process of tightening the screws. The chances for misalignment of the faceplate are reduced because of this engagement between the female connectors and the wedge body. Furthermore, the female connectors provide the screw threads that can easily be replaced, if worn. The wedge body and entire golf club does not have to be replaced.

The separation of the metal club head and the faceplate also reduces manufacturing costs and the time to make a golf club head and faceplate without affecting quality of the golf club. The faceplates can be formed of different materials, independent from the metal club head. The cross bar section connecting the ends of the covered U-shaped frame increase the ease of machining and finishing of the metal portions of the wedge body. The machining of the faceplate and wedge body can be accomplished faster with the present invention to reduce manufacturing time.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A sand wedge type golf club comprising:

an elongated shaft;

a metal club head including a wedge body and a hosel, said hosel being secured to said elongated shaft, said wedge body having a covered, generally U-shaped frame portion with a cross bar section positioned across the open portion of said U-shape, a front face and a back face between a toe and a heel, said front face being planar at a toe portion, said generally U-shaped frame portion forming a cavity on said front face, when said generally U-shaped frame portion is viewed from in front of said front face;

a replaceable metal face plate having a contact surface, a mounting surface and a body therebetween, said mounting surface engaging said cavity and having female connecting means formed on said mounting surface, said contact surface being co-planar with said front face of said metal club head at a toe portion of said wedge body, said contact surface having a plurality of grooves;

said female connecting means including internal threads wherein said internal threads extend into but not through said body of said replaceable metal face plate;

a plurality of headed screws extending through said cross bar and the bottom of said generally U-shaped frame portion to threadably engage said internal threads of said female connecting means on said mounting surface of said replaceable metal face plate.

2. The sand wedge type golf club, as defined in claim 1, wherein said cavity formed in said generally U-shaped frame portion includes an indentation with a plurality of tiers, said plurality of tiers forming a proximal shoulder ledge and a distal stop ledge.

3. The sand wedge type golf club, as defined in claim 2, wherein said holes extending through the bottom of said generally U-shaped frame portion pass through said distal stop ledge.

4. The sand wedge type golf club, as defined in claim 1, wherein said replaceable metal face plate is made from a first metal, said metal club head being made from a second metal.

5. A sand wedge type golf club comprising:

an elongated shaft;

a metal club head including a wedge body and a hosel, said hosel being secured to said elongated shaft, said wedge body having a generally U-shaped frame portion with a cross bar section extending across the top of said generally U-shaped frame portion and having a plurality of holes formed therethrough, a front face and a back face between a toe and a heel, said front face being planar at a toe portion, said generally U-shaped frame portion forming a cavity on said front face, when said generally U-shaped portion is viewed from in front of said front face, said cavity being an indentation with a plurality of tiers, said plurality of tiers forming a proximal shoulder ledge and a distal stop ledge, said distal stop ledge having a plurality of holes formed therethrough;

a replaceable metal face plate having a contact surface, a mounting surface and a body therebetween, said mounting surface being insertable into said cavity in said generally U-shaped frame portion and having internally threaded female connecting means formed on said mounting surface, said internally threaded female connecting means being positioned to align with said holes of said distal stop ledge and said cross bar section, said contact surface being flush with said front face at a toe portion of said wedge body, said contact surface having a plurality of grooves; and a plurality of headed screws extending through said cross bar section and the bottom of said generally U-shaped frame portion.

* * * * *